US009457387B2

(12) United States Patent
Ashton et al.

(10) Patent No.: US 9,457,387 B2
(45) Date of Patent: Oct. 4, 2016

(54) APPARATUS FOR WASHING AND DRYING TOTES AND RELATED METHODS

(71) Applicants: Deborah J. Ashton, Tonawanda, NY (US); Thomas E. Letizia, Wheaton, IL (US); Allen S. Pucciani, Beavercreek, OH (US); Brian E. Stump, Englewood, OH (US)

(72) Inventors: Deborah J. Ashton, Tonawanda, NY (US); Thomas E. Letizia, Wheaton, IL (US); Allen S. Pucciani, Beavercreek, OH (US); Brian E. Stump, Englewood, OH (US)

(73) Assignee: PREMARK FEG L.L.C., Glenview, IL (US)

( * ) Notice: Subject to any disclaimer, the term of this patent is extended or adjusted under 35 U.S.C. 154(b) by 616 days.

(21) Appl. No.: 13/783,460

(22) Filed: Mar. 4, 2013

(65) Prior Publication Data

US 2014/0246058 A1 Sep. 4, 2014

(51) Int. Cl.

| | |
|---|---|
| ***B08B 1/02*** | (2006.01) |
| ***B08B 3/02*** | (2006.01) |
| ***B08B 5/00*** | (2006.01) |
| ***B08B 9/093*** | (2006.01) |
| ***B08B 9/08*** | (2006.01) |
| ***B08B 3/04*** | (2006.01) |
| ***B08B 5/02*** | (2006.01) |
| ***B05B 1/00*** | (2006.01) |
| ***B05B 1/06*** | (2006.01) |

(52) U.S. Cl.

CPC ..... *B08B 9/0861* (2013.01); *B05B 1/005* (2013.01); *B05B 1/06* (2013.01); *B08B 3/022* (2013.01); *B08B 3/042* (2013.01); *B08B 5/00* (2013.01); *B08B 5/02* (2013.01); *B08B 5/023* (2013.01)

(58) Field of Classification Search

CPC ..... B08B 1/02; B08B 9/0813; B08B 9/205; B08B 1/20; B08B 3/02; B08B 3/042; B08B 5/00; B08B 5/02; B08B 5/023; B05B 1/005; B05B 1/06

USPC ..... 134/51, 61, 63, 67, 68, 70, 71, 72, 94.1, 134/95.1, 95.2, 95.3, 135

See application file for complete search history.

(56) References Cited

U.S. PATENT DOCUMENTS

| | | | | |
|---|---|---|---|---|
| 5,601,102 | A * | 2/1997 | Rivette | B08B 9/0826 134/111 |
| 6,122,895 | A | 9/2000 | Schubert | |
| 6,129,099 | A * | 10/2000 | Foster | B08B 1/02 134/111 |
| 8,864,912 | B2 * | 10/2014 | Jakob | B08B 5/02 134/15 |
| 2010/0163653 | A1 * | 7/2010 | Pucciani | B21D 53/06 239/557 |
| 2011/0024528 | A1 | 2/2011 | Pucciani | |
| 2014/0137896 | A1 * | 5/2014 | Margolis | B08B 9/0861 134/22.18 |

* cited by examiner

*Primary Examiner* — Saeed T Chaudhry
(74) *Attorney, Agent, or Firm* — Thompson Hine LLP

(57) ABSTRACT

A machine and method are provided for washing a tote or other container having a bottom wall, and first and second opposed side walls that are connected by first and second opposed end walls to define an access opening. The machine and method involve utilizing an automated washing machine having a housing that includes a wash zone for spraying wash liquid onto the container, a downstream rinse zone for spraying rinsing liquid onto the tote and a downstream drying zone for directing air flow onto the container to promote drying of the container and a conveyor mechanism for moving the container through the housing. The container is placed in an inverted position on the conveyor mechanism with the bottom wall facing upward and the access opening facing downward, and the conveyor mechanism moves the container through the zones for cleaning.

9 Claims, 6 Drawing Sheets

APPARATUS FOR WASHING AND DRYING TOTES AND RELATED METHODS

TECHNICAL FIELD

This application relates generally to an apparatus and method for washing and drying totes and, more specifically, to an apparatus and method in which a conveyor is used to move the totes through a washing zone, a rinsing zone and a drying zone.

BACKGROUND

Totes are used in a wide variety of applications in many industries to transport quantities of various items. In the food industry such items may include produce, meats, fruits, vegetables and dairy products. Such articles are also used extensively in factories to help transport industrial parts from one work area to another or between plants or from a factory to a warehouse or end user. Trays are also used in the food industry. The totes and trays often become dirty, especially with repeated use. Totes are frequently stored outdoors of convenient and grocery stores—which are prone to debris such as animal droppings, bugs, etc., which can be difficult to remove and sanitize. Providing an effective and efficient means of keeping the totes and trays clean is of interest to tote and tray users.

U.S. Pat. No. 6,129,909 discloses a washing apparatus that can be used with pallets, totes and other containers. The apparatus utilizes side-located spray arms that rotationally driven by a motor. In one embodiment vertically extending, side-located air knives are used.

It would be desirable to provide a washing apparatus and method that is less complex and that provides effective cleaning and drying of totes and other containers.

SUMMARY

In one aspect, an apparatus for washing a tote includes a housing that includes a wash zone for spraying wash liquid onto the tote, a downstream rinse zone for spraying rinsing liquid onto the tote and a downstream drying zone for directing air flow onto the tote to promote drying of the tote. A conveyor mechanism is provided for moving the tote through the wash zone, the rinse zone and the drying zone. The tote has a bottom wall, and first and second opposed side walls that are connected by first and second opposed end walls to define an access opening that is closable by first and second lid members, each lid member pivotably connected to a respective one of the side walls. The conveyor mechanism includes a first pusher and a second pusher extending upward therefrom and spaced apart along a direction of travel of the conveyor, where the tote is positioned in an inverted manner on the conveyor mechanism with (i) the bottom wall facing upward, (ii) the access opening facing downward, (iii) the first lid member pivoted away from the access opening and supported on the first pusher so as to angle upward and away from the conveyor with a free end of the first lid member facing in a downstream direction and (iv) the second lid member pivoted away from the access opening and supported on the second pusher so as to angle upward and away from the conveyor with a free end of the second lid member facing in an upstream direction.

In one implementation of the apparatus of the preceding paragraph, the drying zone includes an air manifold having a plurality of spaced apart nozzles extending from side to side over the width of the conveyor mechanism, including a first nozzle oriented to direct air flow toward a portion of a lip structure that is associated with the first end wall, a second nozzle oriented to direct air flow toward a portion of the lip structure that is associated with the second end wall, and multiple intermediate nozzles located between the first nozzle and the second nozzle, where each of the first nozzle and the second nozzle are sized and configured to output a higher volume and/or velocity of air than each of the multiple intermediate nozzles.

In one implementation of the apparatus according the preceding paragraph, a hold down mechanism formed by multiple hold down rods extending in a direction of travel of the conveyor mechanism, the hold down rods at least in part aligned with the air manifold and the plurality of spaced apart nozzles, where each nozzle is offset laterally from each of the hold down rods such that air flow exiting the nozzles is not directed onto the hold down rods.

In one implementation of the apparatus according to the preceding paragraph, the drying zone further includes a first lower air manifold and a second lower air manifold, the first lower air manifold having a plurality of spaced apart nozzles extending across the width of the conveyor mechanism and oriented to direct air upward into the tote, the second lower air manifold having a plurality of spaced apart nozzles extending across the width of the conveyor mechanism and oriented to direct air upward into the tote, each nozzle of the second lower air manifold being offset laterally from each nozzle of the first lower air manifold.

In one implementation of the apparatus according to any one of the four preceding paragraphs, the conveyor mechanism includes lateral structure that maintains a lateral position of the tote on the conveyor mechanism so that the first nozzle is aligned with the portion of the lip structure associated with the first end wall and the second nozzle is aligned with the portion of the lip structure associated with the second end wall.

In another aspect, an apparatus for washing a container includes a housing that includes a wash zone for spraying wash liquid onto the container, a downstream rinse zone for spraying rinsing liquid onto the container and a downstream drying zone for directing air flow onto the container to promote drying of the container. A conveyor mechanism is provided for moving the container through wash zone, rinse zone and drying zone. The container has a bottom wall, and first and second opposed side walls that are connected by first and second opposed end walls to define an access opening that includes an external lip structure. The container is positioned in an inverted manner on the conveyor mechanism with the bottom wall facing upward, the access opening facing downward and the lip structure positioned proximate the conveyor mechanism with the first and second opposed end walls located at opposite sides of the conveyor mechanism. The drying zone includes an upper air manifold having a plurality of spaced apart nozzles extending from side to side across the width of the conveyor mechanism, including a first nozzle oriented to direct air flow toward a portion of the lip structure that is associated with the first end wall, a second nozzle oriented to direct air flow toward a portion of the lip structure that is associated with the second end wall, and multiple intermediate nozzles located between the first nozzle and the second nozzle, where each of the first nozzle and the second nozzle are sized and configured to output a higher volume and/or velocity of air than each of the multiple intermediate nozzles.

In one implementation of the apparatus of the preceding paragraph, a hold down mechanism formed by multiple hold down rods extends in a direction of travel of the conveyor mechanism, the hold down rods at least in part aligned along the conveyor mechanism with the upper air manifold and the plurality of spaced apart nozzles, where each nozzle is offset laterally from each of the hold down rods such that air flow exiting the nozzles is not directed onto the hold down rods.

In another aspect, a method is provided for washing a container having a bottom wall, and first and second opposed side walls that are connected by first and second opposed end walls to define an access opening, where the method involves: utilizing an automated wash machine having a housing that includes a wash zone for spraying wash liquid onto the container, a downstream rinse zone for spraying rinsing liquid onto the tote and a downstream drying zone for directing air flow onto the container to promote drying of the container and a conveyor mechanism for moving the container through the housing; placing the container in an inverted position on the conveyor mechanism with the bottom wall facing upward and the access opening facing downward; as the conveyor mechanism moves the container through the housing: (i) spraying wash liquid up into the container in the wash zone; (ii) spraying rinse liquid up into the container in the rinse zone; (iii) directing air onto the container in the drying zone, where the drying zone includes an upper air manifold, a first lower air manifold and a second lower air manifold, the upper air manifold having a plurality of spaced apart nozzles extending across a width of the conveyor mechanism and oriented to direct air downward onto the container, the first lower air manifold having a plurality of spaced apart nozzles extending across the width of the conveyor mechanism and oriented to direct air upward into the container, the second lower air manifold having a plurality of spaced apart nozzles extending across the width of the conveyor mechanism and oriented to direct air upward into the container.

In one implementation of the foregoing method, the second lower air manifold is located downstream of the first lower air manifold, and each nozzle of the second lower air manifold is offset laterally from each nozzle of the first lower air manifold.

In one implementation of the method of the preceding paragraph, the upper air manifold is downstream of the first lower air manifold and upstream of the second lower air manifold.

In one implementation of the method of any one of the three preceding paragraphs, the plurality of spaced apart nozzles of the upper air manifold include a first nozzle oriented to direct air flow toward a lip structure portion of the first end wall, a second nozzle oriented to direct air flow toward a lip structure portion of the second end wall, and multiple intermediate nozzles located between the first nozzle and the second nozzle, where each of the first nozzle and the second nozzle are sized and configured to output a higher volume and/or velocity of air than each of the multiple intermediate nozzles.

On implementation of the method of the preceding paragraph includes utilizing structure of the conveyor mechanism to hold a lateral position of the container on the conveyor mechanism so that the first nozzle is aligned with the lip structure portion of the first end wall and the second nozzle is aligned with the lip structure portion of the second end wall.

The foregoing methods can be implemented using the conveyor mechanism, pusher and pivotable lid orientation and/or hold down bars previously described.

DETAILED DESCRIPTION

Figure 1:
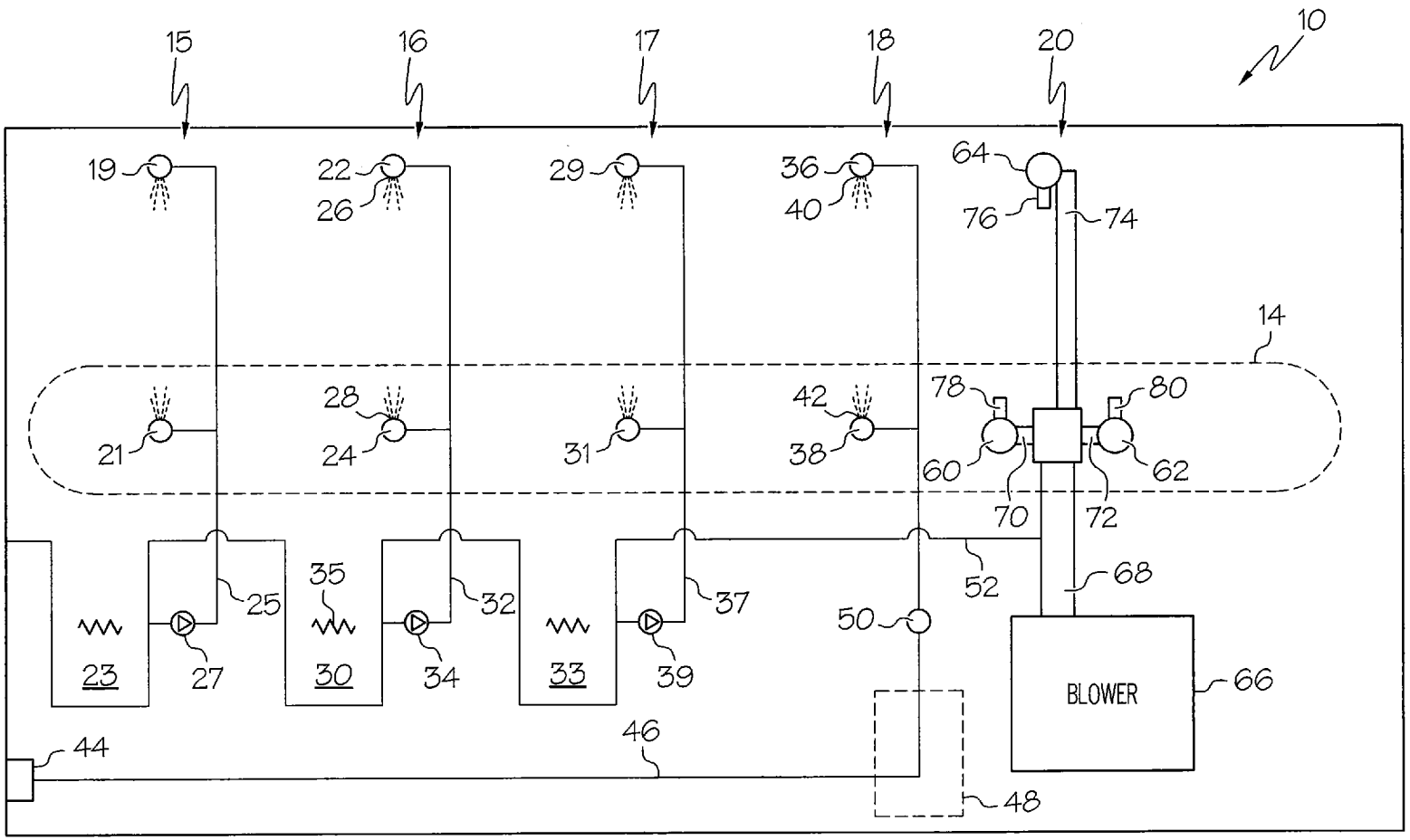
FIG. 1 is a schematic side elevation of one embodiment of a tote washing apparatus.

Referring to FIG. 1 a general schematic depiction of an embodiment of a tote washer 10 is shown. The tote washer includes a housing 12 that defines a tunnel through which totes are moved by a conveyor mechanism 14 that may be motor driven. Internal of the housing multiple treatment zones are provided, including a wash zone 16 for spraying wash liquid onto the totes, a downstream rinse zone 18 for spraying rinsing liquid onto the totes and a downstream drying zone 20 for directing air flow onto the totes to promote drying of the totes. Hanging curtains may be provided between each zone for limiting sprays from one zone to another.

By way of example the wash zone 16 may include upper and lower spray arm manifolds 22 and 24 that extend across the width of the conveyor (into and out of the page in FIG. 1) and that each include multiple nozzles 26 and 28 integrated therein or connected thereto. One upper and one lower arm are shown, but more could be used. Each spray arm may be fed with a supply of washing liquid (e.g., water and detergent solution) from a sump 30 by way of a recirculation line 32 and pump 34. Washing liquid sprayed in the wash zone falls back down into the sump 30 for reuse. The sump may include an internal heating element 35 for heating the washing liquid. The downstream rinse zone 18 may include upper and lower rinse arms 36 and 38, each with respective nozzles 40 and 42. The rinse arms are fed with rinse water (e.g., fresh water with or without a rinse agent) via fresh water input 44 and fresh water supply line 46. A booster heater 48 may be located along the fresh water supply path for heating the rinse water. A valve or pump 50 may be used to control rinse water flow.

In addition to wash zone 16 and rinse zone 18, additional liquid spray zones can be provided as suggested in FIG. 1. Specifically, a pre-wash zone 15 may be located upstream of the wash zone 16 and/or a post-wash zone or power rinse zone 17 may be located between the wash zone 16 and the rinse zone 18 as shown. The pre-wash zone includes its own upper and lower spray arms 19 and 21, sump 23 and recirculation line 25 and pump 27. Likewise, the power-rinse zone includes its own upper and lower wash arms 29, 31, sump 33 and recirculation line 37 and pump 39.

The machine may include directional flow panels 52 that capture falling rinse water from the final rinse zone 18 and direct it into the upstream sump 33 to refresh the liquid of the sump. Overflows from sump 33 are directed to upstream wash zone sump 30, and likewise on to upstream pre-wash zone sump 23, with the sump 23 including an overflow to drain (not shown) so that dirty water can leave the sump as the cleaner, used water enters the sump 23.

Figure 2:
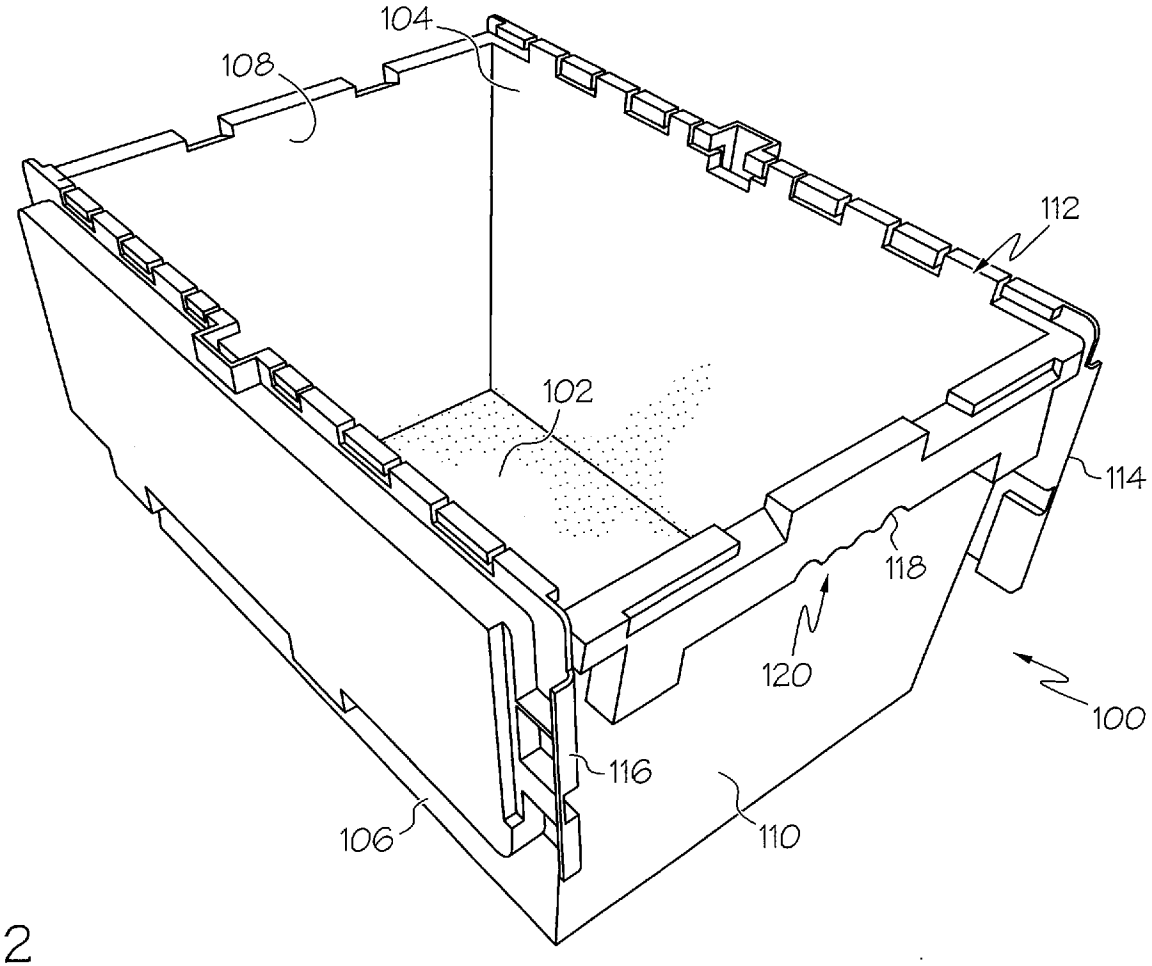
FIG. 2 is a perspective view of a tote.

A representative tote 100 is shown in dashed line form in FIG. 1, placed upon the conveyor mechanism. Referring to FIG. 2, it is contemplated that each tote includes a bottom wall 100, and opposed side walls 102 and 104 that are connected by opposed end walls 106 and 108 to define an access opening 112 that is closable by lid members 114 and 116, where each lid member is pivotably connected to a respective one of the side walls. In FIG. 2, each lid member 114 and 116 is shown pivoted away from the access opening 112 and laying alongside the external surface of its respective side wall 104 and 106. Proximate the access opening 112 each of the side and end walls includes external lip structure 118 primarily to add structural integrity to the tote, which may be of a molded plastic configuration. The lip structure may create a downward facing gap or groove 120 as well. As will be described in greater detail below, it is contemplated that totes will be placed on the conveyor mechanism in an inverted orientation, with the bottom wall facing upward and the access opening facing downward.

Referring again to FIG. 1, the drying zone 20 includes lower air manifolds 60 and 62 spaced apart in the direction of travel through the machine and an upper air manifold 64, each of which is supplied with air via a blower 66 and air flow duct paths 68, 70,72 and 74. The upper air manifold 64 includes a plurality of spaced apart nozzles 76 extending across a width of the conveyor mechanism and oriented to direct air downward onto the totes. Each of the lower air manifolds 60 and 62 includes a respective plurality of air nozzles 78 and 80 extending across the width of the conveyor mechanism an oriented to direct air upward into the totes. In one embodiment, each of the air manifolds and associated nozzles may be of a configuration similar to that shown and described in U.S. Patent Publication No. 2010/0163653, published on Jul. 2, 2010. It is noted that the air flow from blower 66 to the manifolds may be balanced, with approximately fifty percent of the air flow directed to upper manifold 64 and approximately 25% of the air flow directed to each of the lower manifolds 60 and 62, with such flow controlled primarily by the size of the ducting to each manifold. However, variations in how the air flow is split between the various air manifolds is possible. By way of example, total air flow in the drying zone may be between about 500 and about 1500 CFM at between about 30" and about 90" WC (pressure), but variations are possible.

Figure 3:
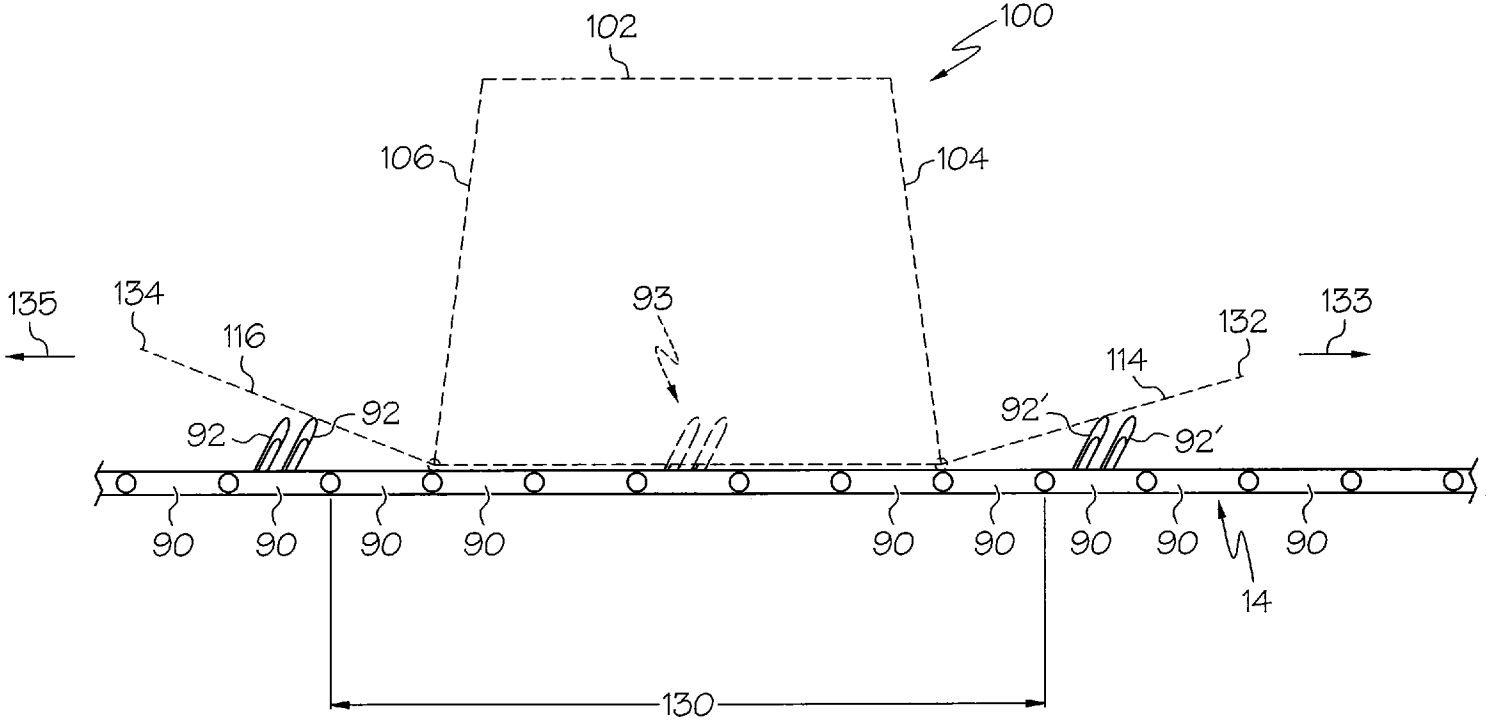
FIG. 3 is a partial side schematic elevation showing a tote moving along the conveyor.

Referring now to FIG. 3, a schematic depiction of a tote 100 supported on the conveyor mechanism 14 is shown. In the illustrated embodiment, the conveyor mechanism is formed by a plurality of pivotally interconnected metal links 90. Certain links are formed with upwardly extending pushers (e.g., 92 and 92'—generally finger-shaped). The pushers 92 and 92' are spaced apart along a direction of travel of the conveyor (e.g., left to right in FIG. 3) defining a gap 130 into which the tote 100 is positioned in an inverted manner with (i) the bottom wall 102 facing upward, (ii) the access opening facing downward, (iii) lid member 114 pivoted away from the access opening and supported on one or more pushers 92' so as to angle upward and way from the conveyor 14 with a free end 132 of lid member 114 facing in a downstream direction 133 and (iv) lid member 116 pivoted away from the access opening and supported on one or more pushers 92 so as to angle upward and away from the conveyor 14 with a free end 134 of the lid member 116 facing in an upstream direction 135. By providing a suitable spacing between the pushers 92 and 92' to facilitate this tote orientation on the conveyor, the lid members are oriented in a manner that facilitates cleaning as well as draining of both washing liquid and rinsing liquid off of the lid members. Thus, the rim of the tote opening rests on a major, substantially horizontal plane of the conveyor, while the lid members are supported on the pushers that are elevated relative the major plane of the conveyor.

It is recognized that the pushers would generally be arranged on the conveyor mechanism 14 in a manner to produce multiple sequential gaps 130 into which multiple respective totes can be placed. It is further recognized that the spacing between the pushers could be set such that one or more sets of pushers extend upward into the cavity of the tote when the tote is positioned on the conveyor (e.g., per the pushers shown in dashed line form at 93). During cleaning, where the lid members are pivotally attached to the tote, the lower sprays of liquid and/or drying liquid may temporarily cause the lid members to pivot upward alongside the respective side walls of the tote, and when the lid members have move past such sprays, the lid members will tend to pivot back down to be supported on the pushers in the upwardly angled arrangement.

Figure 4:
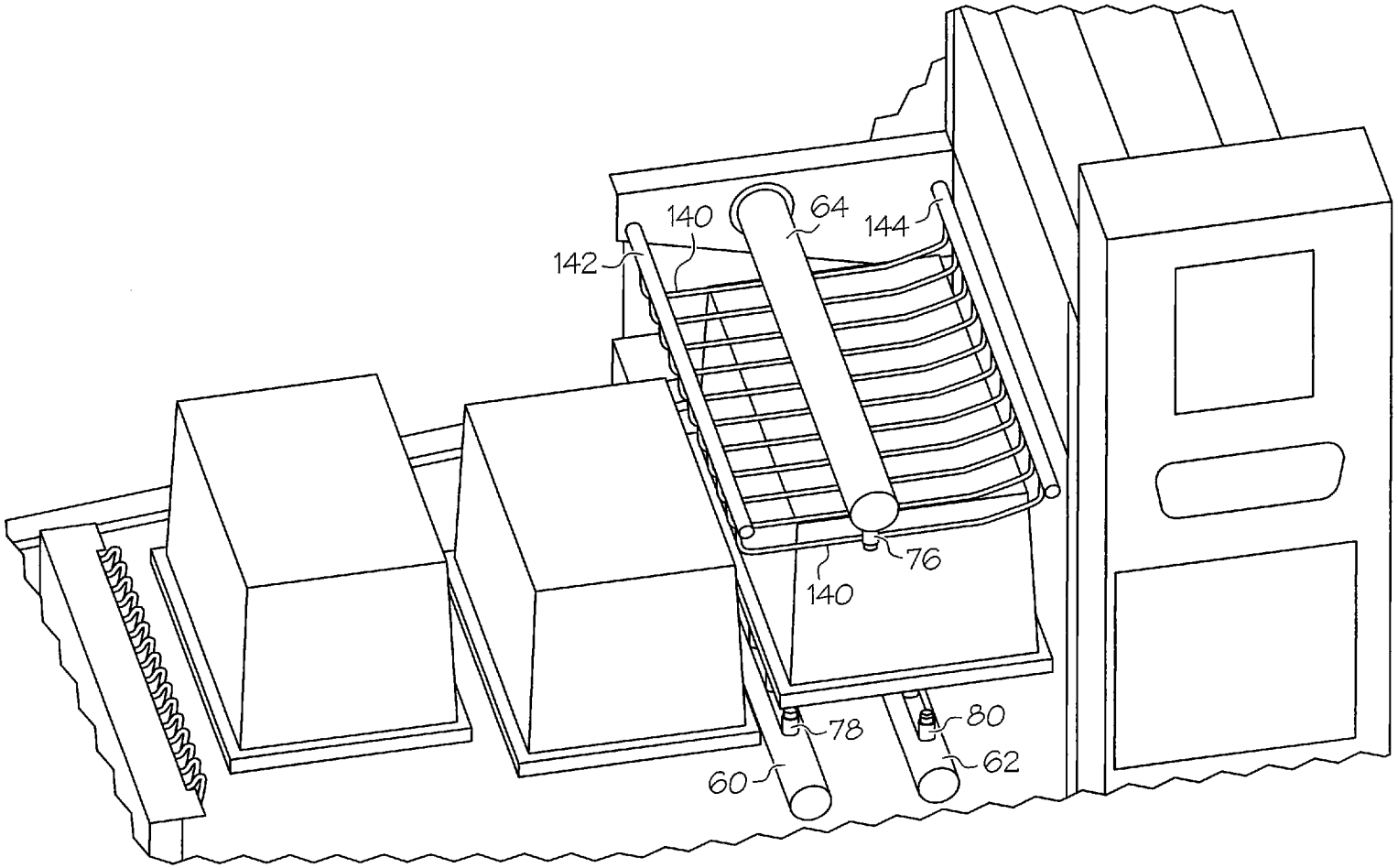
FIG. 4 is a partial perspective view of the drying zone.
Figure 5:
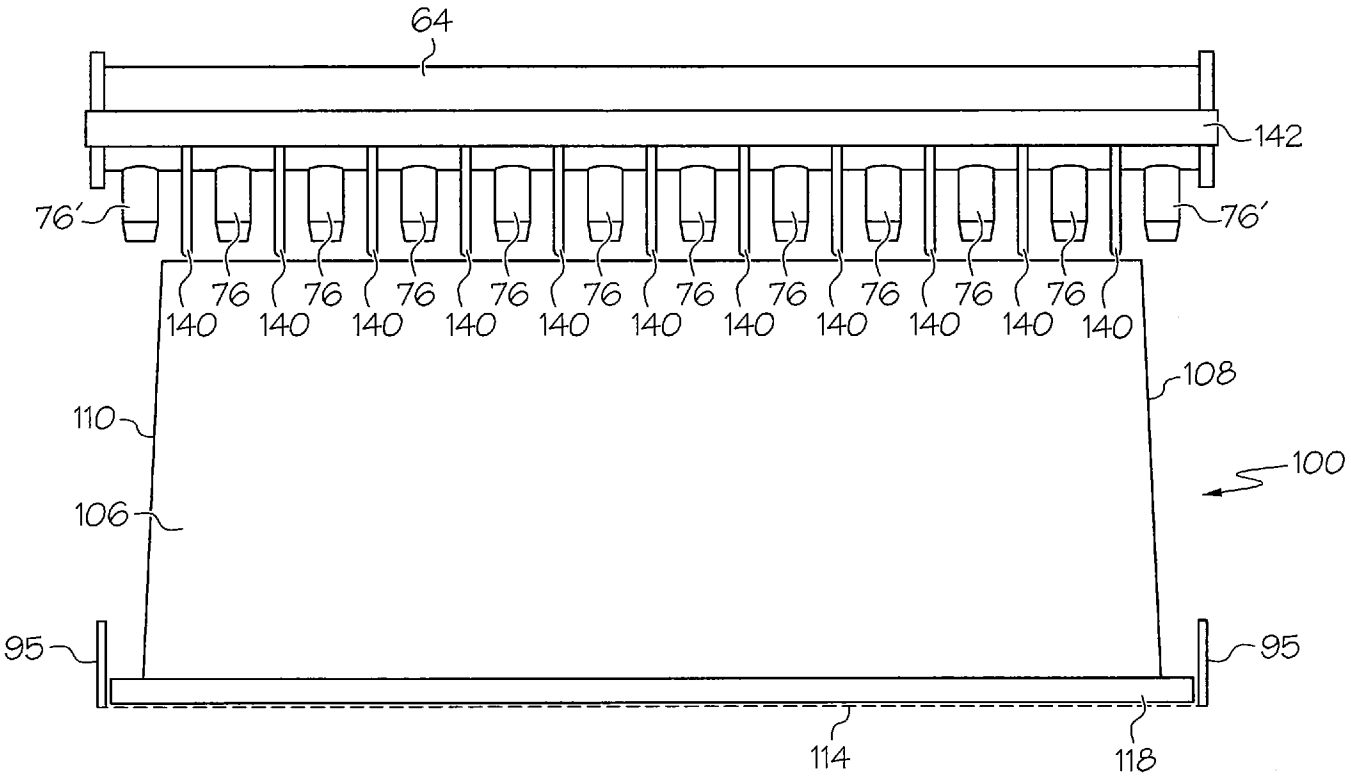
FIG. 5 is a partial end elevation view of a tote, upper air manifold and hold down rods.

Referring now to FIG. 4 (lid members not shown), a partial perspective view of the drying zone is shown. The zone includes a plurality hold down rods 140 are spaced apart across the width of the conveyor and extend in a direction of travel of the conveyor. In the illustrated embodiment the hold down rods (e.g., wire form members) extend between two lateral support bars 142 and 144. The hold down rods are aligned with the upper air manifold 64 such that the upper air manifold extends over the rods. The hold down rods are spaced above the conveyor a distance that substantially matched the elevation of the bottom wall of the tote travelling along the conveyor, so that the rods will stabilize the tote as air is directed onto the tote from below and above. As best seen in FIG. 5 (lid members not shown in this view), each of the plurality of spaced apart nozzles 76 of the upper manifold is offset laterally from each of the hold down rods 140 such that air flow exiting the nozzles 76 is not directed onto the hold down rods, providing for more effective drying of the tote without the rods disturbing the air flow.

In addition, in order to more effectively dry the portions of the lip structure 118 associated with each of the end walls 108 and 110, the end nozzles 76' of the manifold may be sized and configured to output a higher volume and/or velocity of air than each of the multiple intermediate nozzles 76. Moreover, the conveyor mechanism 14 may be formed with lateral guides 95 to properly position the totes relative to the end nozzles 76' to assure best performance. Thus, the guides would maintain the tote in a lateral position so that the end nozzles 96' direct air toward the portions of the lip structure 118 running along the end walls. By way of example, the lateral guides 95 may be formed by a series of upward extensions (e.g., similar to the pushers) running along the length of the conveyor.

Figure 6:
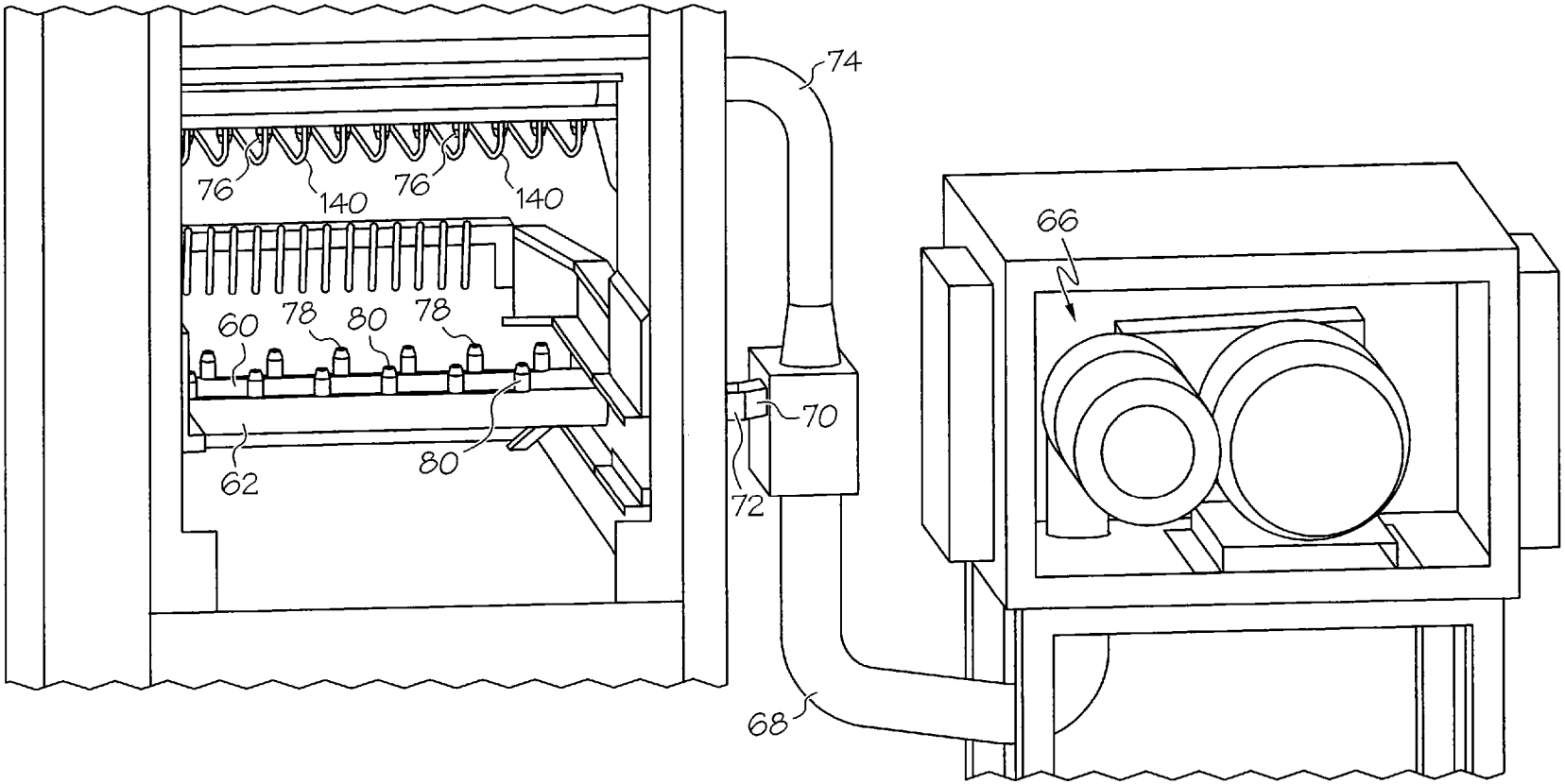
FIG. 6 is a partial perspective showing offset nozzles of the two lower air manifolds.

As seen in the partial perspective view of FIG. 6, looking upstream along the conveyor, each of the spaced apart nozzles 78 of lower air manifold 60 are offset laterally from each spaced apart nozzle 80 of the lower air manifold 62. Likewise, each of the nozzles should be positioned to spray liquid upward through gaps in the conveyor (e.g., lateral spaces between different sets of links of the conveyor). As also seen in FIG. 6, the blower 66 may be located in a separate housing unit that sits alongside the main housing structure of the washing apparatus. However, embodiments in which the blower is incorporated within or atop the main housing structure are contemplated.

The tote washing machine and method gives wholesaler/distributors who utilize totes peace of mind knowing that clean, sanitized totes are being used for their fresh food products. Whether shipping tobacco, snacks or fresh food, the clean appearance of the washed tote lets their customers know they care about them and the products delivered. The tote washer can also be used to wash trays that are used for beverage, bread and sandwiches.

It is to be clearly understood that the above description is intended by way of illustration and example only, is not intended to be taken by way of limitation, and that other changes and modifications are possible.

What is claimed is:

1. An apparatus for washing a tote, the apparatus comprising:

a housing that includes a wash zone for spraying wash liquid onto the tote, a downstream rinse zone for spraying rinsing liquid onto the tote and a downstream drying zone for directing air flow onto the tote to promote drying of the tote;

a conveyor mechanism for moving the tote through the wash zone, the rinse zone and the drying zone;

wherein the tote has a bottom wall, and first and second opposed side walls that are connected by first and second opposed end walls to define an access opening that is closable by first and second lid members, each lid member pivotably connected to a respective one of the side walls;

wherein the conveyor mechanism includes a first pusher and a second pusher extending upward therefrom and spaced apart along a direction of travel of the conveyor, where the tote is positioned in an inverted manner on the conveyor mechanism with (i) the bottom wall facing upward, (ii) the access opening facing downward, (iii) the first lid member pivoted away from the access opening and supported on the first pusher so as to angle upward and away from the conveyor with a free end of the first lid member facing in a downstream direction and (iv) the second lid member pivoted away from the access opening and supported on the second pusher so as to angle upward and away from the conveyor with a free end of the second lid member facing in an upstream direction;

wherein the drying zone includes an air manifold having a plurality of spaced apart nozzles extending from side to side over the width of the conveyor mechanism, including a first nozzle oriented to direct air flow toward a portion of a lip structure that is associated with the first end wall, a second nozzle oriented to direct air flow toward a portion of the lip structure that is associated with the second end wall, and multiple intermediate nozzles located between the first nozzle and the second nozzle, where each of the first nozzle and the second nozzle are sized and configured to output a higher volume and/or velocity of air than each of the multiple intermediate nozzles.

2. The apparatus of claim 1, further comprising:

a hold down mechanism formed by multiple hold down rods extending in a direction of travel of the conveyor mechanism, the hold down rods at least in part aligned with the air manifold and the plurality of spaced apart nozzles, where each nozzle is offset laterally from each of the hold down rods such that air flow exiting the nozzles is not directed onto the hold down rods.

3. The apparatus of claim 2, wherein the drying zone further includes a first lower air manifold and a second lower air manifold, the first lower air manifold having a plurality of spaced apart nozzles extending across the width of the conveyor mechanism and oriented to direct air upward into the tote, the second lower air manifold having a plurality of spaced apart nozzles extending across the width of the conveyor mechanism and oriented to direct air upward into the tote, each nozzle of the second lower air manifold being offset laterally from each nozzle of the first lower air manifold.

4. The apparatus of claim 1 wherein the conveyor mechanism includes lateral structure that maintains a lateral position of the tote on the conveyor mechanism so that the first nozzle is aligned with the portion of the lip structure associated with the first end wall and the second nozzle is aligned with the portion of the lip structure associated with the second end wall.

5. An apparatus for washing a container, the apparatus comprising:

a housing that includes a wash zone for spraying wash liquid onto the container, a downstream rinse zone for spraying rinsing liquid onto the container and a downstream drying zone for directing air flow onto the container to promote drying of the container;

a conveyor mechanism for moving the container through wash zone, rinse zone and drying zone;

wherein the container has a bottom wall, and first and second opposed side walls that are connected by first and second opposed end walls to define an access opening that includes an external lip structure;

wherein the container is positioned in an inverted manner with the bottom wall facing upward, the access opening facing downward and the lip structure positioned proximate the conveyor mechanism with the first and second opposed end walls located at opposite sides of the conveyor mechanism;

wherein the drying zone includes an upper air manifold having a plurality of spaced apart nozzles extending from side to side across the width of the conveyor mechanism, including a first nozzle oriented to direct air flow toward a portion of the lip structure that is associated with the first end wall, a second nozzle oriented to direct air flow toward a portion of the lip structure that is associated with the second end wall, and multiple intermediate nozzles located between the first nozzle and the second nozzle, where each of the first nozzle and the second nozzle are sized and configured to output a higher volume and/or velocity of air than each of the multiple intermediate nozzles.

6. The apparatus of claim 5, further comprising:

a hold down mechanism formed by multiple hold down rods extending in a direction of travel of the conveyor mechanism, the hold down rods at least in part aligned along the conveyor mechanism with the upper air manifold and the plurality of spaced apart nozzles, where each nozzle is offset laterally from each of the hold down rods such that air flow exiting the nozzles is not directed onto the hold down rods.

7. An apparatus for washing a tote, the apparatus comprising:

a housing that includes a wash zone for spraying wash liquid, a downstream rinse zone for spraying rinsing liquid and a downstream drying zone for directing air flow for drying;

a conveyor mechanism for moving a tote through the wash zone, the rinse zone and the drying zone, wherein the tote has a bottom wall, and first and second opposed side walls that are connected by first and second opposed end walls to define an access opening that includes an external lip structure and wherein the tote is positioned in an inverted manner on the conveyor mechanism;

wherein the drying zone includes an air manifold having a plurality of spaced apart nozzles extending from side to side over a width of the conveyor mechanism and directed to flow air downward toward the conveyor mechanism, including a first end nozzle, a second end nozzle, and multiple intermediate nozzles located between the first end nozzle and the second end nozzle, where each of the first end nozzle and the second end nozzle are sized and configured to output a higher volume and/or velocity of air than each of the multiple intermediate nozzles.

8. The apparatus of claim 7, further comprising:

a hold down mechanism formed by multiple laterally spaced apart hold down rods extending in a direction of travel of the conveyor mechanism, the hold down rods at least in part aligned with the air manifold and the plurality of spaced apart nozzles, where each nozzle is offset laterally from each of the hold down rods such that air flow exiting the nozzles is not directed onto the hold down rods.

9. The apparatus of claim 8, wherein the drying zone further includes a first lower air manifold and a second lower air manifold, the first lower air manifold having a plurality of spaced apart nozzles extending across the width of the conveyor mechanism and oriented to direct air upward into the tote, the second lower air manifold having a plurality of spaced apart nozzles extending across the width of the conveyor mechanism and oriented to direct air upward into the tote, each nozzle of the second lower air manifold being offset laterally from each nozzle of the first lower air manifold.

* * * * *